US006659463B2

(12) United States Patent
Mackey

(10) Patent No.: US 6,659,463 B2
(45) Date of Patent: Dec. 9, 2003

(54) INTERCONNECTING MINIATURE TOY FIGURINE BASES WITH RECORD TRACKING SYSTEM

(76) Inventor: Thomas J. Mackey, 182 Glasgow Rd., Pittsburgh, PA (US) 15237

( * ) Notice: Subject to any disclaimer, the term of this patent is extended or adjusted under 35 U.S.C. 154(b) by 0 days.

(21) Appl. No.: 10/189,354

(22) Filed: Jul. 3, 2002

(65) Prior Publication Data

US 2003/0085517 A1 May 8, 2003

Related U.S. Application Data

(63) Continuation-in-part of application No. 09/479,531, filed on Jan. 7, 2000.

(60) Provisional application No. 60/115,162, filed on Jan. 8, 1999.

(51) Int. Cl.[7] ..... A63F 3/00; A63H 33/04

(52) U.S. Cl. ..... 273/276; 273/289; 273/290; 446/117; 446/125

(58) Field of Search ..... 273/288, 289, 273/255, 262, 276, DIG. 26, 290, 287, 283, 284, 281, 282.1, 236, 241; 446/117, 120, 122, 124, 125, 128; 116/222, 321; 235/65, 66, 68, 69

(56) References Cited

U.S. PATENT DOCUMENTS

| | | | | | |
|---|---|---|---|---|---|
| 3,610,626 | A | * | 10/1971 | Nolte | 273/261 |
| 3,806,125 | A | * | 4/1974 | Bialek | 273/260 |
| 4,317,570 | A | * | 3/1982 | Brunton | 273/246 |
| 5,306,015 | A | * | 4/1994 | Daud et al. | 273/242 |
| 5,871,212 | A | * | 2/1999 | Lee | 273/283 |
| 5,895,046 | A | * | 4/1999 | Lee | 273/288 |
| 2002/0180150 | A1 | | 12/2002 | Weisman | |
| 2003/0071414 | A1 | | 4/2003 | Weisman | |

OTHER PUBLICATIONS

The Adventurers Guide to DarkWorld, 1992, 10pgs., Mattel Inc. El Sequindo, California, U.S.A.

* cited by examiner

*Primary Examiner*—Stephen Blau
(74) *Attorney, Agent, or Firm*—Blynn L. Shideler; Krisanne Schideler; BLK Law Group

(57) ABSTRACT

Gaming equipment for a variety of games has buildable structures formed of building blocks, movement measurement devices for measuring game piece movement and projectile range values, structural unit guides to aid in construction of the buildable structures, movable game pieces and universal sub-bases for toy miniatures.

19 Claims, 8 Drawing Sheets

INTERCONNECTING MINIATURE TOY FIGURINE BASES WITH RECORD TRACKING SYSTEM

CROSS-REFERENCE TO RELATED APPLICATION

This application is a continuation-in-part of U.S. patent application Ser. No. 09/479,531 filed Jan. 7, 2000 entitled "Castle Blocks Board Game" which is incorporated herein by reference and which claims the benefit of U.S. Provisional Patent Application Serial No. 60/115,162, filed Jan. 8, 1999, entitled "Castle Blocks Board Game".

BACKGROUND OF THE INVENTION

1. Field of the Invention

The present invention relates to games and, more particularly, to building block and miniature toy gaming.

2. Description of the Prior Art

Board games challenge the mind and teach various skills and concepts, such as formulating strategies, sharing, socializing, competing, winning, and losing.

A common drawback of most board games designed for children, however, is that the format of the game is so structured that a child's imagination is constrained. For example, many commercially produced board games must be played on pre-printed boards, with game pieces traveling on a never-changing pathway. Many board games also incorporate instruction cards that order a player to move their game piece, lose a turn, or execute some other command. As these games are played repeatedly, the game becomes more predictable, less challenging, and less appealing to play.

Another disadvantage of many commercial board games designed for children is that the method of play is so random that original, independent thought does not help the child achieve the explicit goal of the game—winning. For example, many board games are often driven solely by the random appearance of colors or the roll of a die. In these types of games, the child has no input into the outcome of the game and is completely controlled by probabilities.

Still another disadvantage of many board games is that the games are not educational. Many games do not require a player to count past six, the number of sides on a conventional die. Moreover, these games are essentially two-dimensional, with no requirement to estimate distances, evaluate how objects are constructed, or recognize geometrical objects.

It is therefore an object of the present invention to provide toy equipment that allows for interactive, educational games that encourages input from the players and allows the players to make their own decisions, choose their own strategies, and directly affect the outcome of the game.

In addition to the board games described above, miniature toy gaming has developed a significant following. In miniature toy gaming, participants use a collection of toy miniatures to play a given scenario. The miniatures may be, for example, historical representations (e.g. Napoleonic era soldiers), fantasy figures (e.g. elves, wizards, dragons, etc.) or science fiction characters. The game play of these often elaborate representations is hindered through piece movement limitations. It is a further object of the present invention to improve the game play of miniature toy gaming.

SUMMARY OF THE INVENTION

To obviate the drawbacks of the prior art, the present invention is directed toward a gaming system comprising a sub-base for receiving a miniature figurine, wherein the sub-base includes at least one attachment member for interconnecting the sub-base with an adjacent sub base. The gaming system includes a tracking member on each sub-base for recording changing characteristics of the associated figurine.

The present invention further provides a method of playing a game comprising the steps of:

a. building a structure using structural units and at least one structural unit guide;

b. assembling game pieces in proximity to said structure;

c. determining range values for each game piece using a movement measurement device;

d. moving each game piece within a permissible movement range value;

e. engaging in mathematical combat with game pieces controlled by an opposing side; and f. removing captured game pieces from play.

The present invention further provides a movement measurement device for a game having distinct game pieces constructed to measure range values of said games pieces and including an attaching member for connecting to the game pieces. The movement measurement device may be a housing with a measuring wheel having body indicia positioned thereon. The structural unit guides for building a structure according to the present invention are positioned adjacent said structural unit guides. The structural unit guide for building a structure are combined with other structural unit guides to aid in building a complete structure with each guide preferably received in grooves formed in the structural members. The grooved structural members help hide the guides and interlock the structural members.

These and other advantages of the present invention will be clarified in the Brief Description of the Preferred Embodiments taken together with the attached drawings in which like reference numerals represent like elements throughout.

DETAILED DESCRIPTION OF THE PREFERRED EMBODIMENTS

An embodiment of the present invention is shown in U.S. patent application Ser. No. 09/479,531 and Provisional Patent Application Serial No. 60/115,162 that are both herein incorporated by reference in their entirety.

Figure 1:
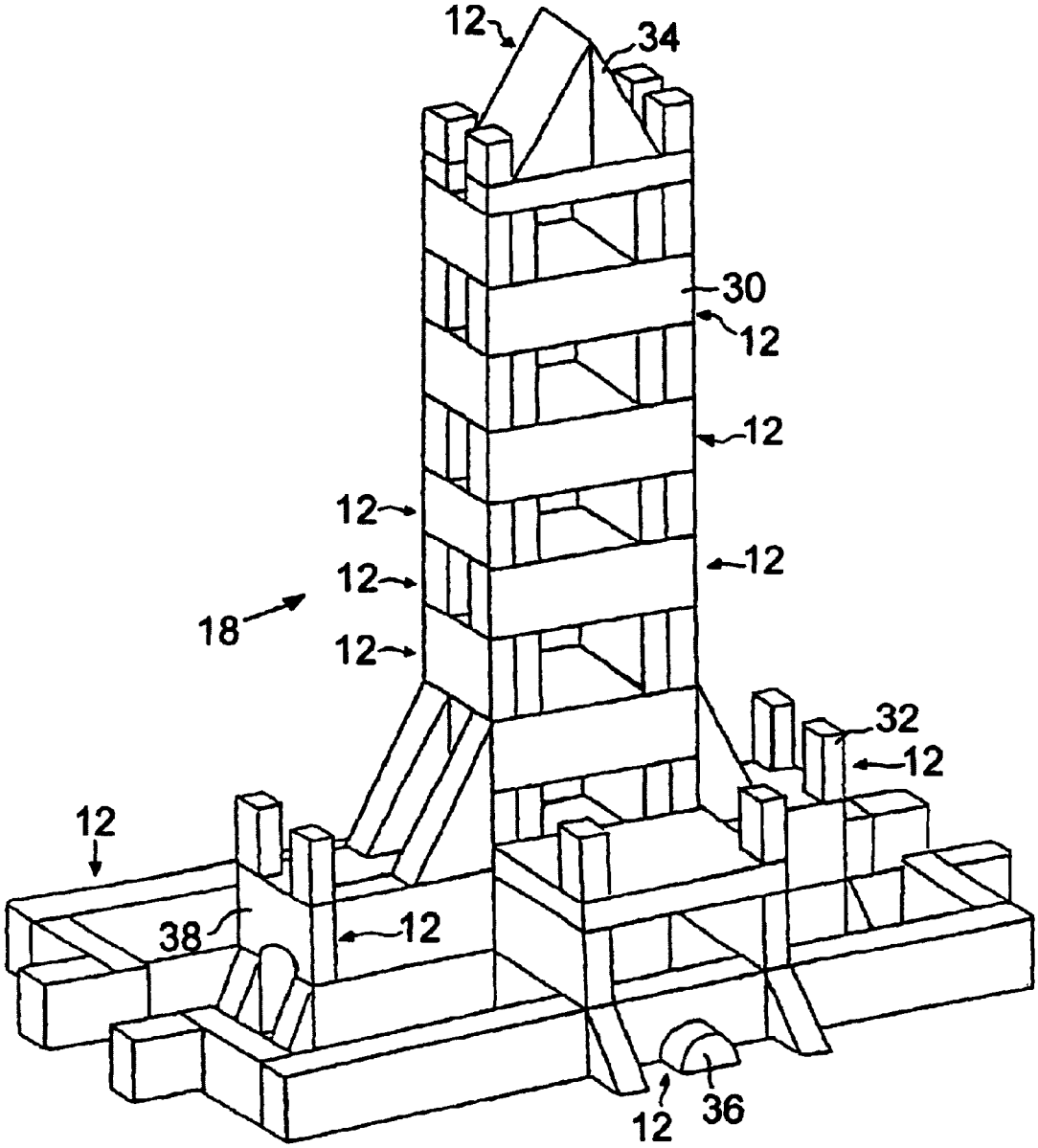
FIG. 1 is a perspective view of one possible tower structure constructed using the equipment of the present invention.
Figure 2:
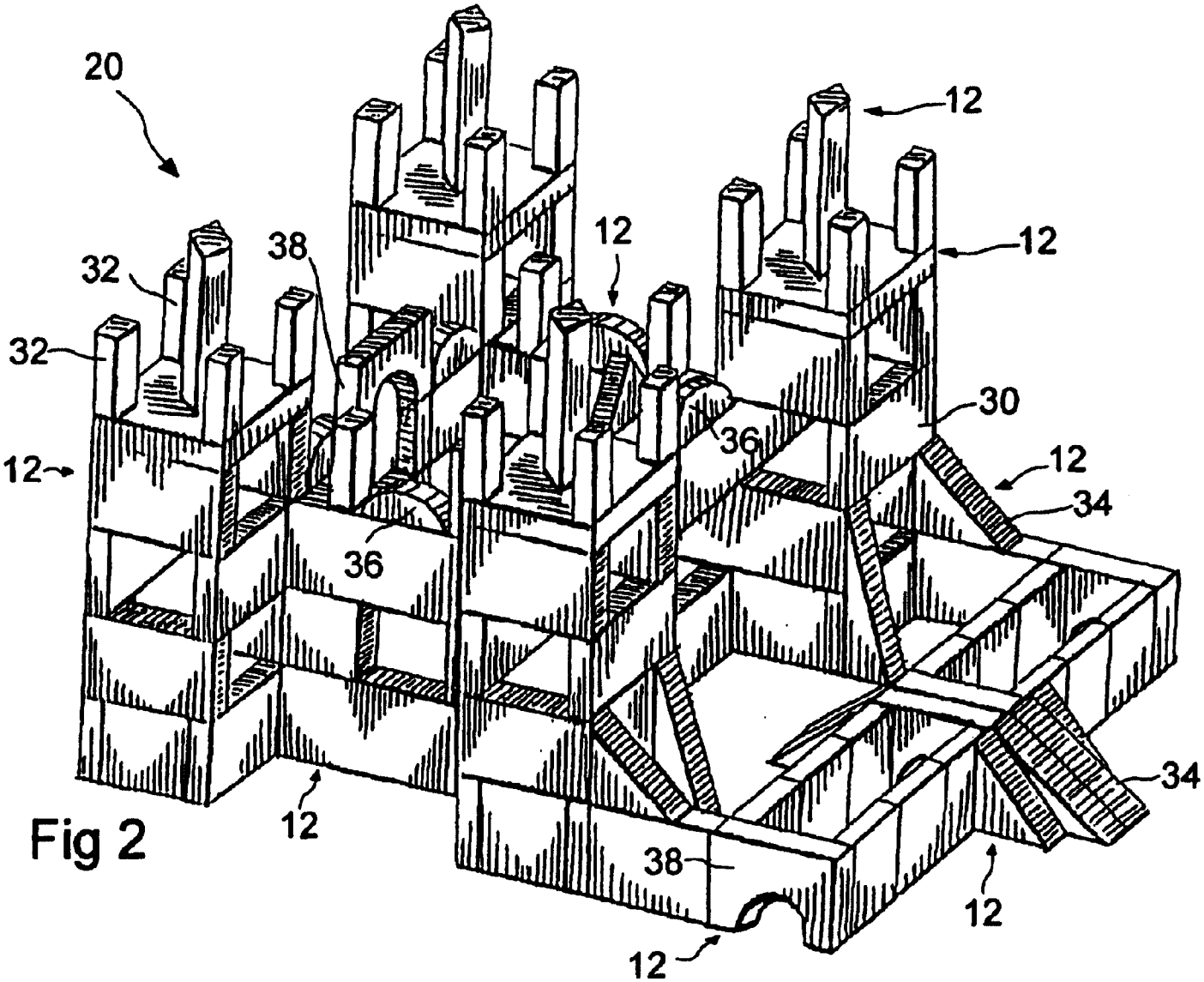
FIG. 2 is a perspective view of one possible castle structure constructed using equipment of the present invention.
Figure 5:
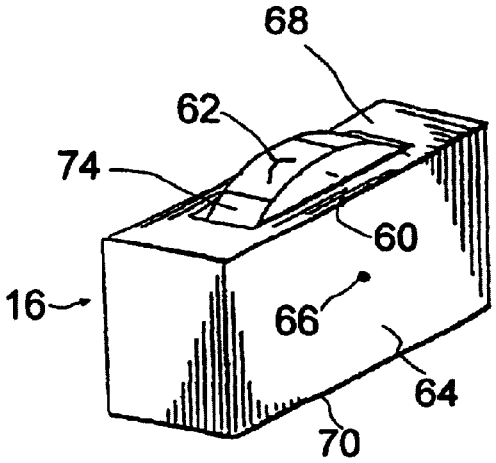
FIG. 5 is a perspective view of one embodiment of a movement measurement device.
Figure 6:
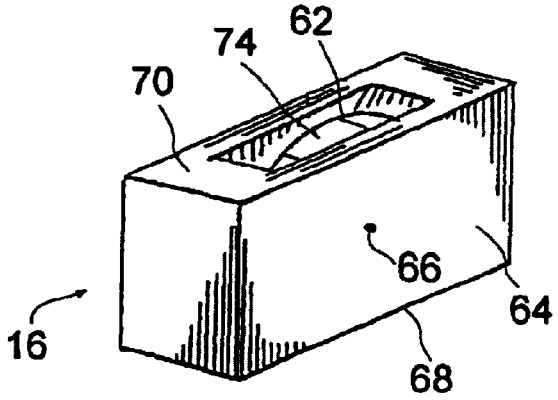
FIG. 6 is a perspective view of a movement measurement device according to the present invention.
Figure 3:
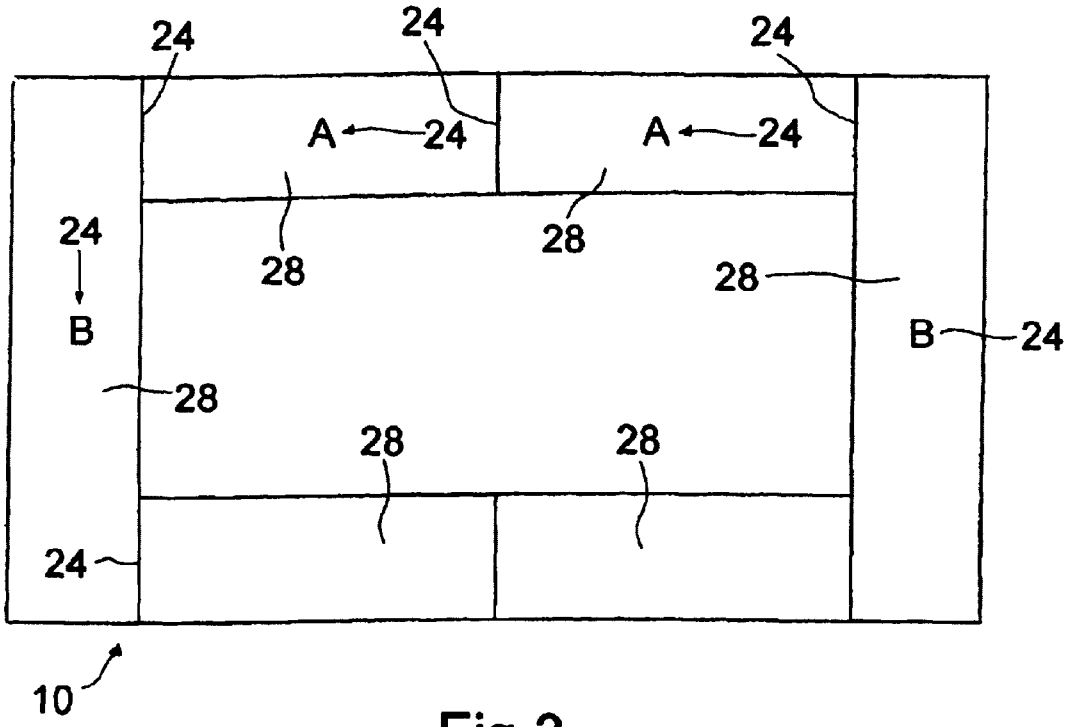
FIG. 3 is a top view of one embodiment of a structural unit guide.

The present invention generally includes at least one structural unit guide 10 or building templates, a plurality of structural units 12 (or building blocks) positioned adjacent the at least one structural unit guide 10 and forming a structure, a plurality of movable game pieces 14 positioned in proximity to the structure, and a movement measurement device 16 constructed to measure movement and range values R of the game pieces 14, including movement range value and projectile range value. FIG. 1 shows a structure, constructed from structural units 12, representing a free-standing tower 18. FIG. 2 illustrates a second structure, constructed from the same structural units 12 as the tower 18, representing a free-standing castle 20. FIG. 3 shows one embodiment of a structural unit guide 10 or building template. FIGS. 5 and 6 illustrate a movement measurement device 16.

The tower 18 and castle 20 are both built using structural units 12 and, preferably, structural unit guides 10. As shown in FIG. 3, each structural unit guide 10 is preferably made from a planar material, such as cardboard or other suitable material. Each structural unit guide 10 has a two sides, with either side having structural unit guide indicia 24 that corresponds with structural unit indicia 26 positioned adjacent each structural unit 12. The structural unit guide indicia 24 includes alphabetical letters, colors, or dots corresponding to the structural unit indicia 26, and shadow outlines of various structural units 12, with the shadow outlines forming available spaces 28.

Figure 4:
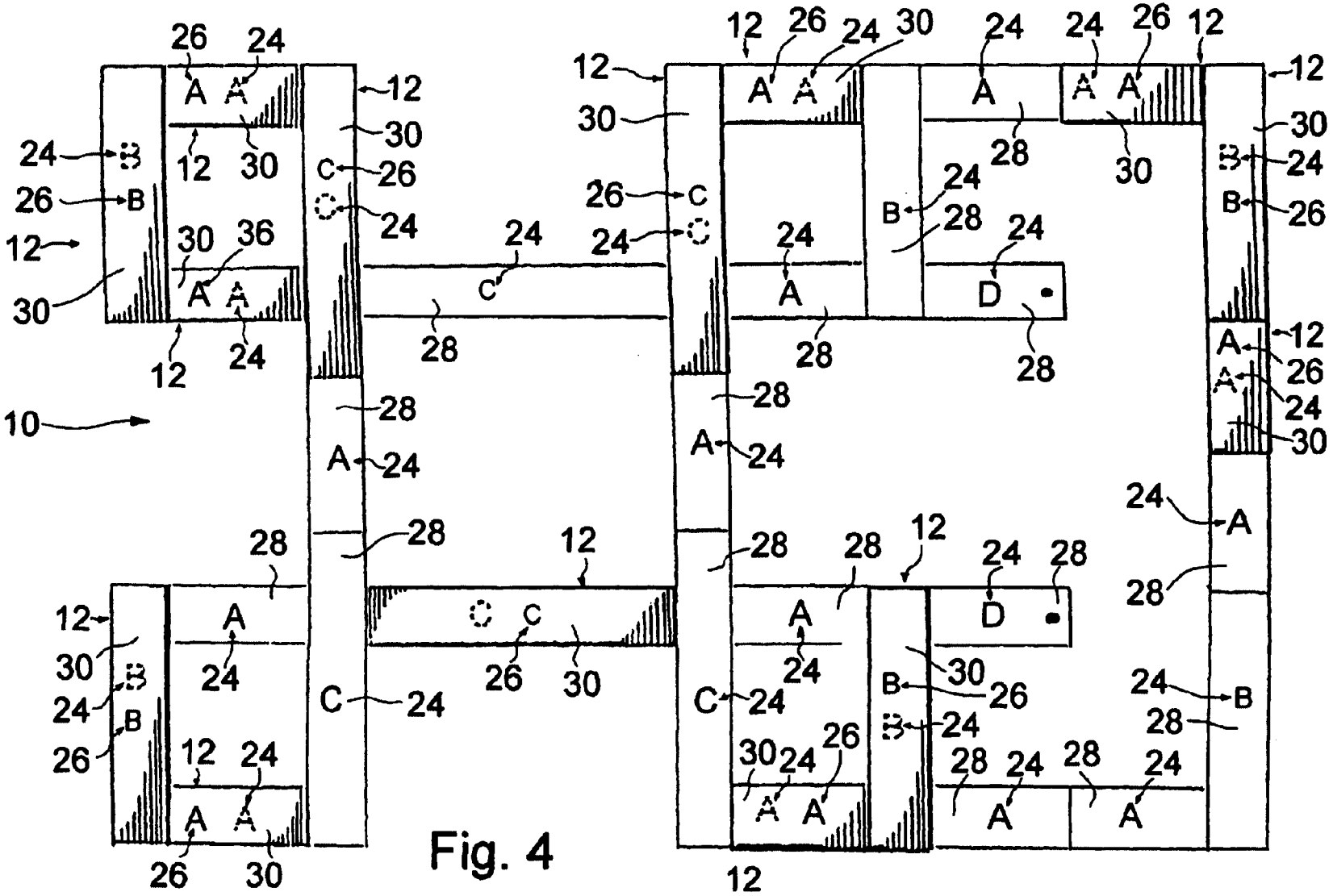
FIG. 4 is a top view of a structural unit guide according to the type shown in FIG. 3 partially filled with structural units.
Figure 7:
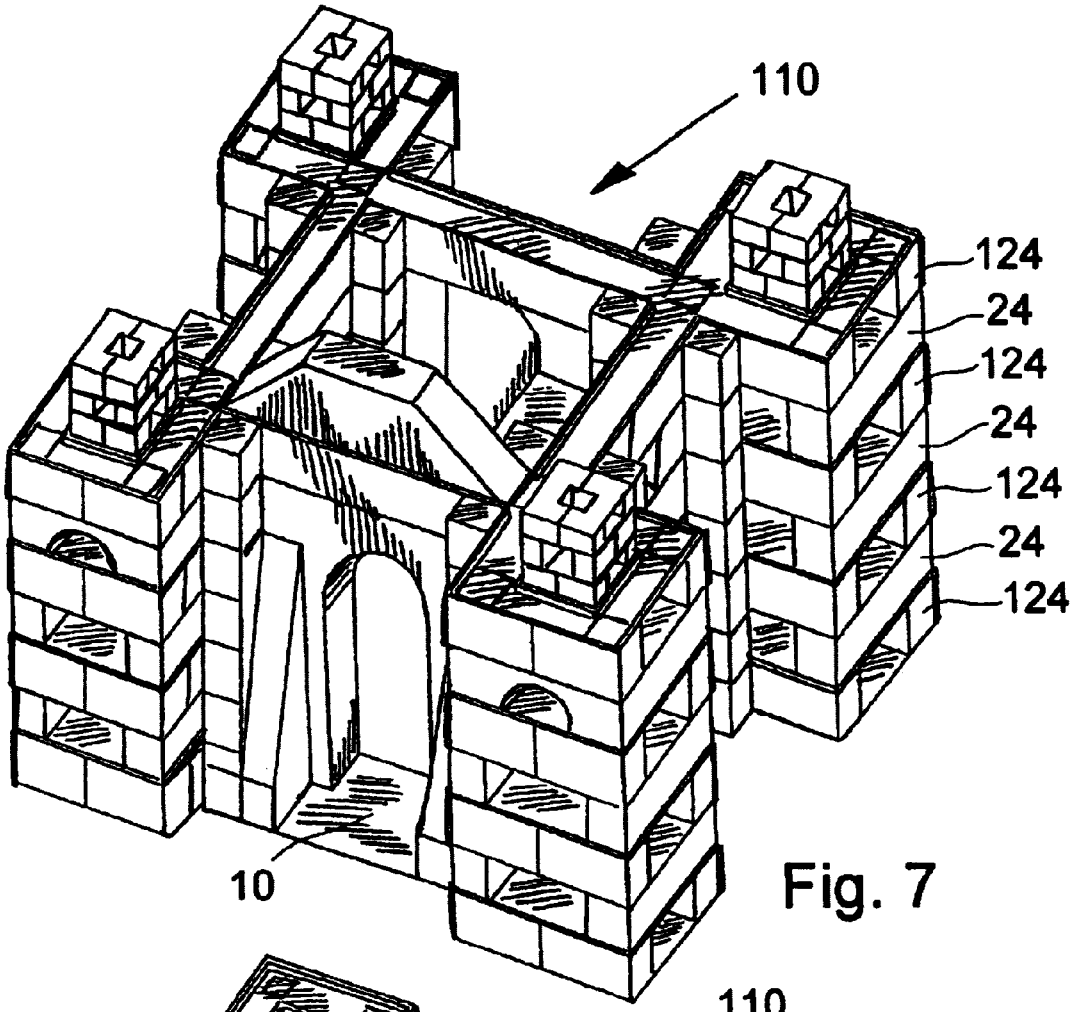
FIG. 7 is a view of one possible castle structure constructed using equipment of the present invention.
Figure 8:
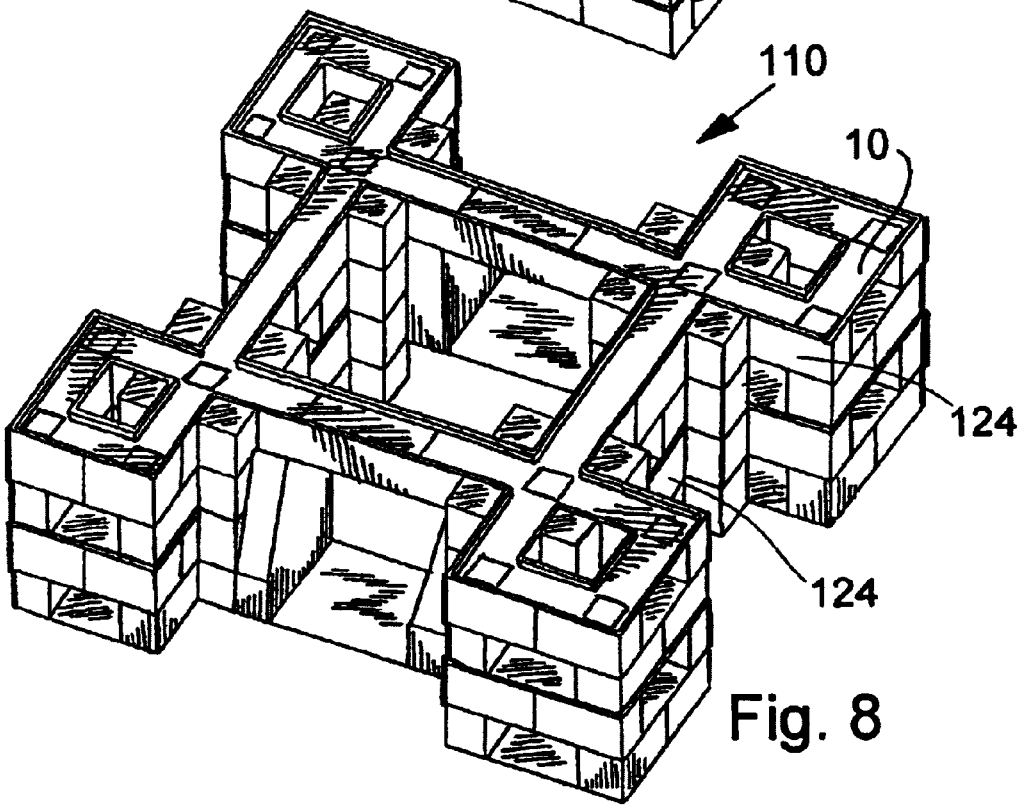
FIG. 8 is a perspective view of the partially assembled castle structure of FIG. 7 constructed using equipment of the present invention.
Figure 9:
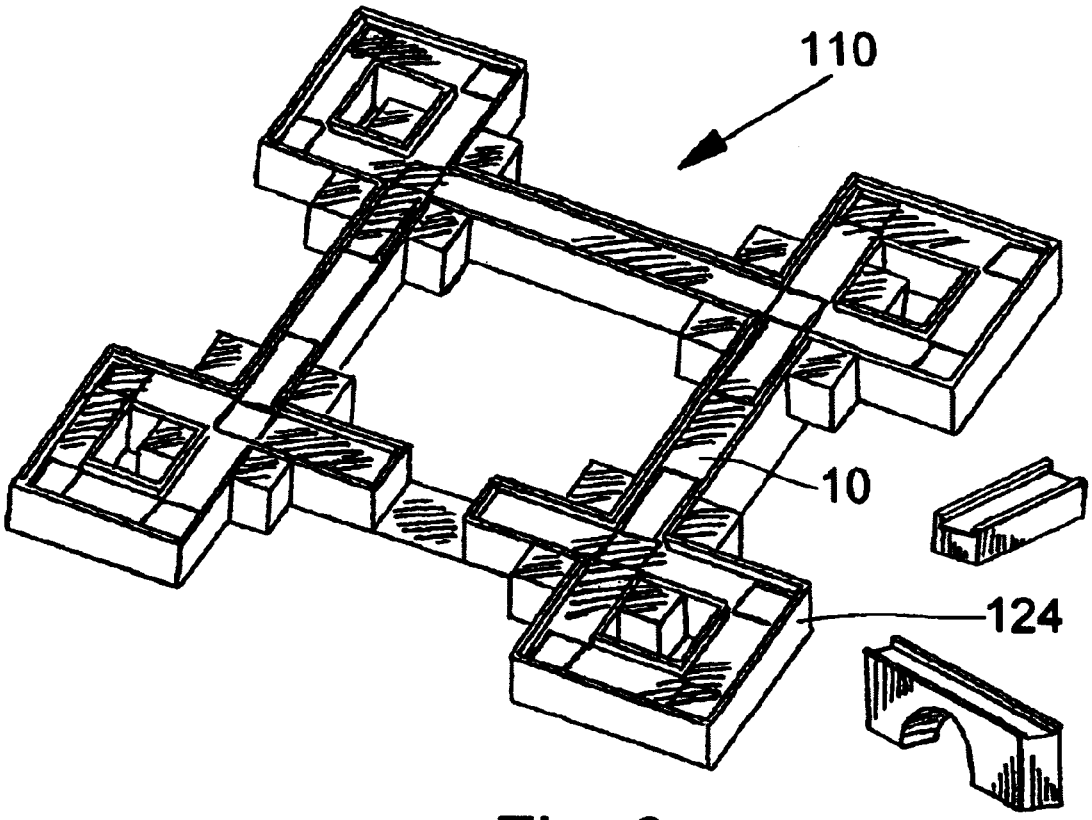
FIG. 9 is a perspective view of the partially assembled castle structure of FIG. 7 constructed using equipment of the present invention.
Figure 10:
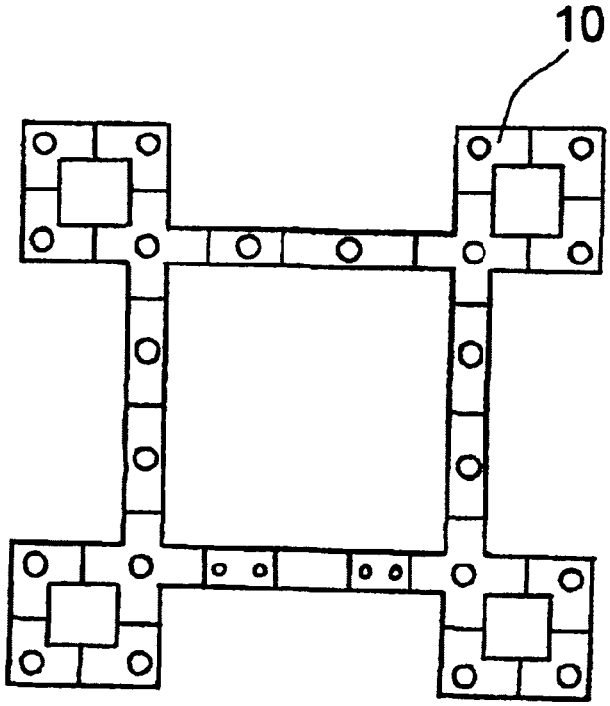
FIG. 10 is a top view of a of a structural unit guide according to the type shown in FIGS. 7–9.
Figure 11:
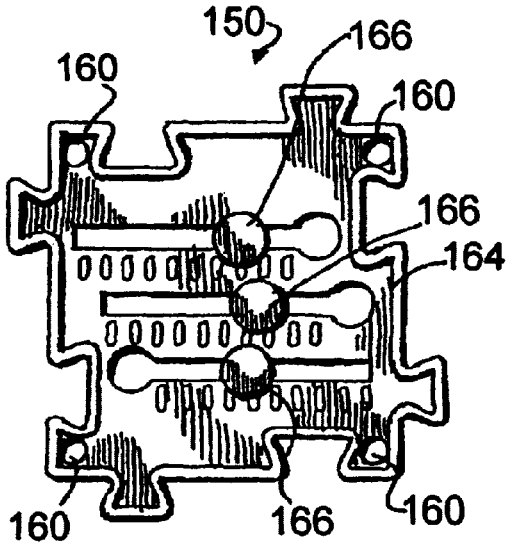
FIG. 11 is a plan view of a miniature sub-base according to the present invention.

As shown in FIG. 4, structural unit guides 10 are stacked on a flat surface for the base of any structure or on a preceding row of structural units 12. Structural units 12 are positioned adjacent the structural unit guides 10. The purpose of the structural unit guides 10 and the structural unit guide indicia 24 is to provide a visual blueprint or template to players, that when used in conjunction with the corresponding structural unit indicia 26 positioned on the structural units 12, aids in the construction of the tower 18 and castle 20. Therefore, other structural unit guides 10, structural unit indicia 26, or structural unit guide indicia 24 may be used to accomplish this purpose.

FIGS. 7–10 illustrate a further castle structure 110 made according to the present invention. The castle structure 110 differs from the tower 18 and the castle 20 mainly through the use of specialized grooved structural units or interlocking blocks 124. The blocks 124 include a groove formed in opposed sides of the blocks 124. The groove serves to receive the template of structural unit guide 10 for the subsequent layer therein which will essentially hide or at least minimize the appearance of the guide 10 in the finished structure 110. As discussed above, certain areas of the guide 10 can be printed with indicia or background to help it blend into the finished structure 110 (e.g. a cobble stone printing). Further the groove in the blocks 124 will receive blocks of adjacent layers therein to interlock the layers to provide a more secure structure 110. The grooved blocks may take a straight H or I beam shape, or include corners as shown in the attached figures. Curved shapes are also possible. Further it is envisioned that a block 124 may have a pivot between two ends along a 45 degree bevel such that the block can be pivoted to a straight or a 90 degree corner block 124.

Range values R, such as movement range value and projectile range value, of game pieces are measured by a movement measurement device 16. One embodiment of a movement measurement device 16 includes a body 60 having a continuous surface 62, such as the periphery of a circular wheel, a sphere, or endless track. The continuous surface 62 allows a player or group of players to measure range values R either linearly or non-linearly. The body 60 of the movement measurement device 16 may be rotatably connected to a housing 64 by an axle 66. The housing 64 has an open end 68 and a window end 70 preferably positioned directly opposite the open end 68. The continuous surface 62 of the body 60 has body indicia 74 positioned thereon, including pictures, letters, numbers, or other symbols, with the body indicia 74 visible through the window end 70 of the housing 64 and the open end 68 of the housing 64.

Further embodiments of the movement measurement device 16 permit range value measurements in three dimensions, such as measuring between a game piece on a first level of a structure and a game piece positioned adjacent a higher level of the structure, through the use of an elongate measuring line (e.g. a retractable string). These embodiments are described in further detail in the above identified parent application. A further line measuring adaptation contemplated for the movement measuring device 16 according to the present invention is including a keyhole slot on the device 16, or other anchor point, for removeably attaching the height measuring line. Moreover, although any of the movement measurement devices 16 discussed above are preferably separate pieces, any of the embodiments may also be incorporated into one or more game pieces. The molding of the device 16 directly with a game piece or figurine may have particular advantage in games for younger children who will not have to separately measure game piece movement (e.g. the movement of the game piece will occur simultaneously with measurement of the move through the device 16).

Figure 13:
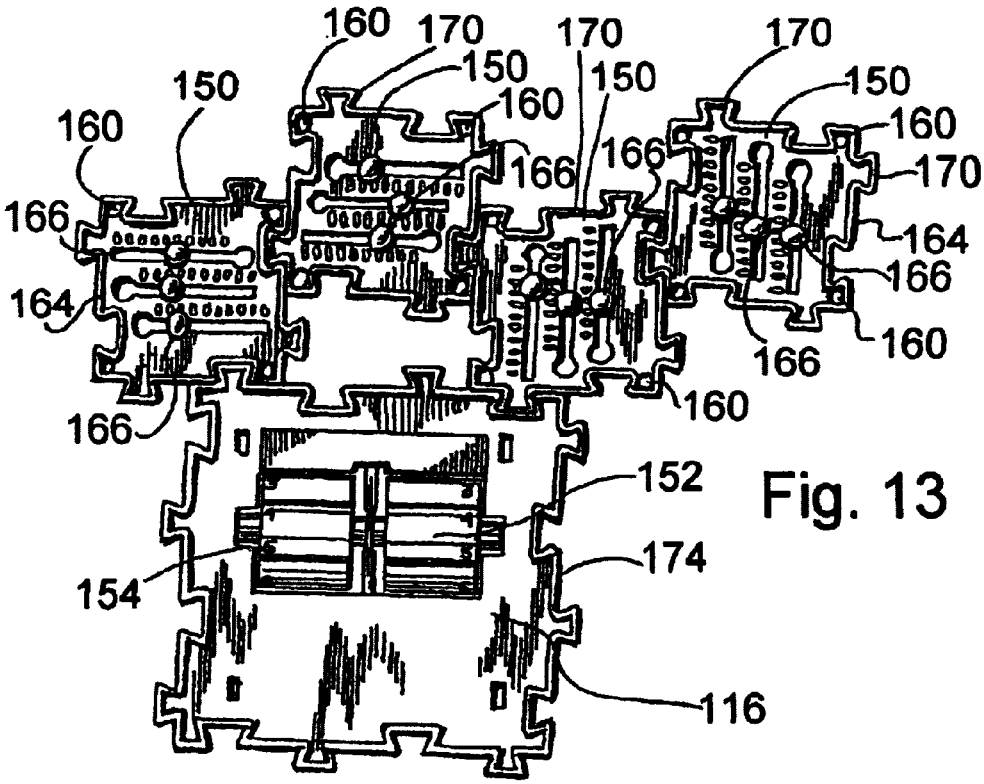
FIG. 13 is a plan view of the assembly of sub-bases according to FIG. 12 with an associated movement-measuring device according to the present invention.

A movement measurement device 116 is shown in FIG. 13 attached to sub-bases 150 according to the present invention. The device 116 includes the measuring wheel 152 with indicia 154 in a similar manner to the device 16 shown above. The indicia 154 may include movement indication on one side and other game related information on the other side, such as combat resolution information.

Figure 15:
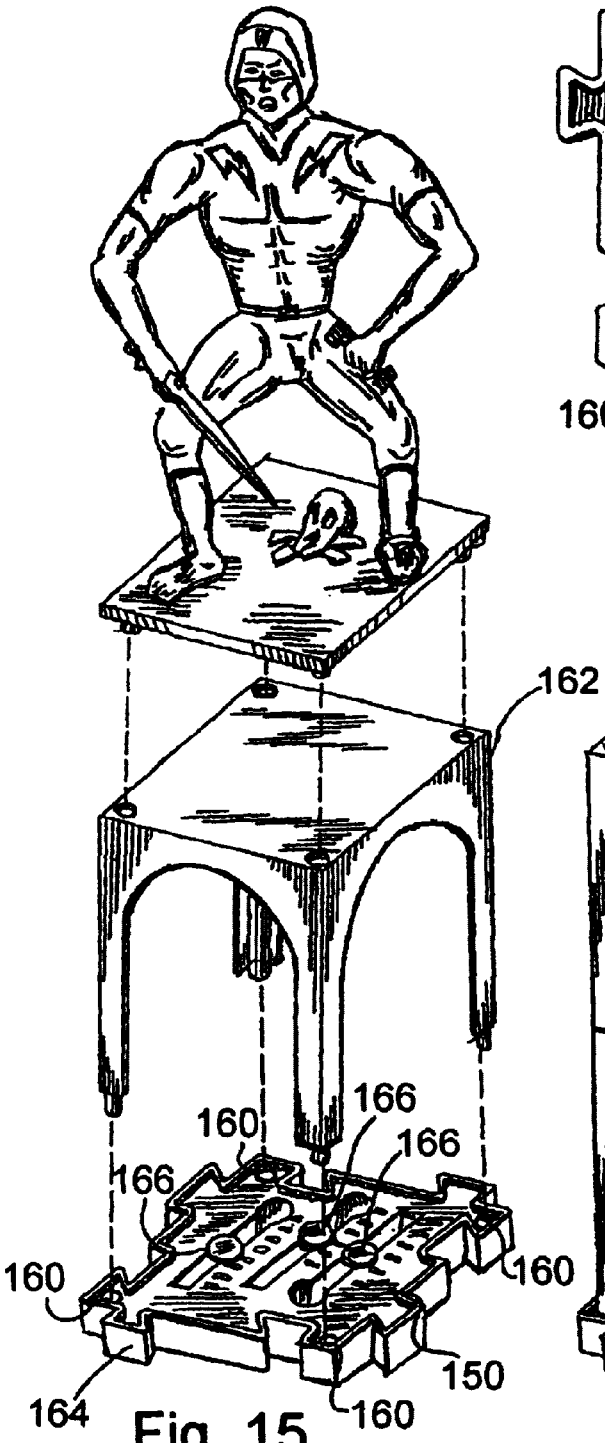
FIG. 15 is a perspective view of a sub-base and toy miniature according to the present invention.
Figure 14:
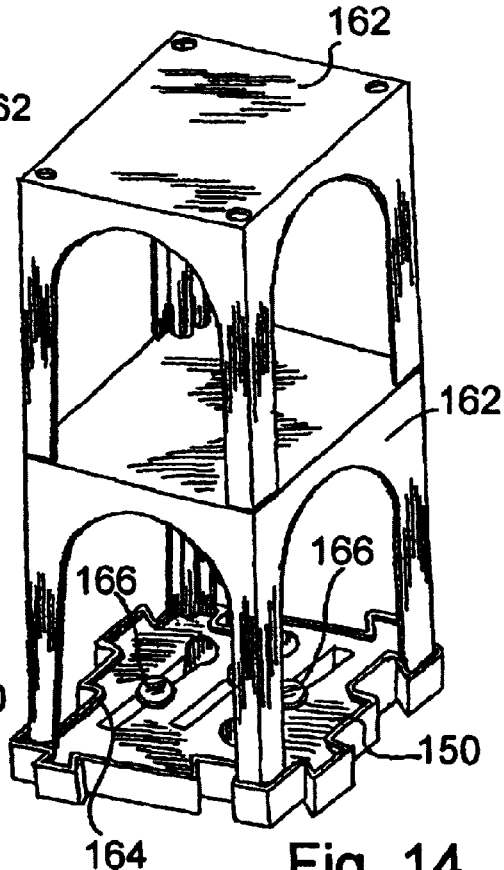
FIG. 14 is a perspective view of height adjustment system for the sub-base according to the present invention.

The sub-base 150 is shown in FIGS. 11–15 and represents a significant improvement for miniature game play. The sub-base 150 is adapted to receive a figurine such as illustrated in FIG. 15. The sub-base 150 includes holes 160 for receipt of corresponding posts in the base of the associated figurine. Additionally the sub-base 150 accommodates one or more height adjusting pedestals 162. The pedestals 162 will allow for figurines to me mounted at varying heights relative to a play surface and could be used for flying characters such as dragons, planes, blimps, spacecraft, etc. The advantage of the pedestals 162 over existing bases is that the pedestals 162 may be added or removed to quickly accommodate altitude changes. It is expected that in the game rules for any particular game the pedestals 162 would be associated with a movement unit for the game piece such that adding or removing a pedestal 162 will "use up" a portion of the game pieces movement value.

Other attachment mechanisms, other than holes 160, are incorporated into the sub-base 150. The raised edge 164 may be sized to engage selected bases for given figurines. The sub-base 150 is designed to fit figurines from a variety of manufacturers to make it more universal.

In addition to the height varying characteristics, the sub-base 150 provides for a record tracking system for the associated miniature. The sub-base 150 include three slides 166 with associated indicia 168 that allows the sub-base to track relevant characteristics of the associated game piece. For example, a game piece may have a limited amount of health, ammo, or other changing parameters, which the sub-base can track. During game-play the slides 166 can be adjusted and referred to as needed to assist in game play. The uses of the slides 166 is limitless and based upon the given play scenario and game playing rules. The object is to allow the association of these characteristics of the miniature to be associated with the game piece.

Figure 12:
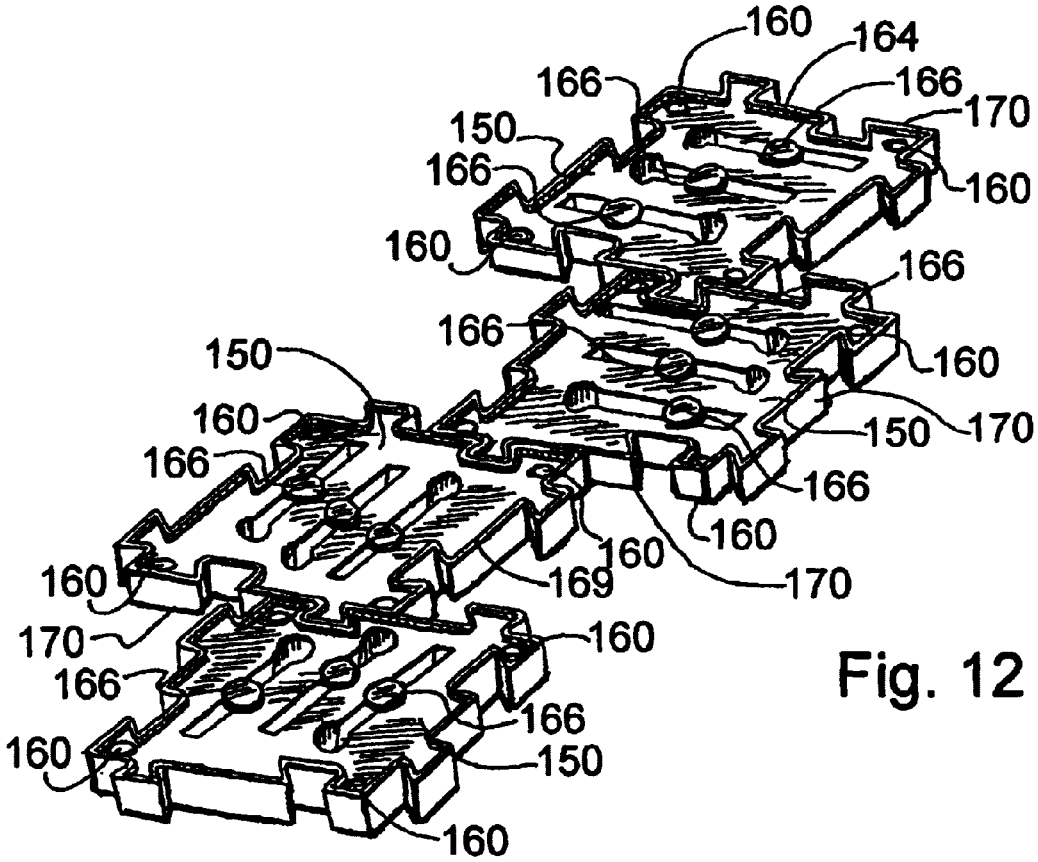
FIG. 12 is a perspective view of an assembly of sub-bases according to the present invention.

A further aspect of the sub-base 150 is the provision of mating structure 170 on the edge to allow for the interconnection of adjacent sub-bases 150 as shown in FIGS. 12 and 13. This interconnection allows for associations of game pieces, e.g. troop formations such as skirmish lines, squads and the like, to be grouped as a unit. This interconnection will greatly facilitate game-play by allowing the grouped unit, e.g. a squad of soldiers, to be moved as a single unit. Additionally it is helpful that the mating structure 170 be attachable and removable in a vertical movement of the associated sub-bases 150. Further the alternating dovetail design on each edge allows the sub-bases 150 to be reversible to attach at base increments. In addition to allowing for the formation of interconnected groups of characters or miniatures, the sub-bases can be combined to receive a larger figurine. For example, in certain figurine sets, two sub-bases 150 may be connected to accommodate a larger figurine such as a horse riding character, or catapult or the like.

As shown in FIG. 15 the movement measuring device 116 includes mating structure 174 which allows for easy connection to a single sub-base 150 or a group of interconnected sub-bases 150. The device 116 may include a cover (not shown) partially covering the measuring wheel or drum with the cover providing a further surface for figurine and other mounting. For example, the cover may provide an appropriate position for a field general or king figurine as well as battle flags or other command structure associated with the overall game scenario.

The above described building block and miniature gaming equipment can be utilized in a wide variety of games as described in the parent application. A further example of the application of the equipment of the present invention is a cave-man role playing game developed by the inventor. The game utilizes at least one male and female figurine representing a single clan for each player. The object of the game is for each player to have his clan collect the appropriate material needed to produce fire and the wheel. Each figurine includes a movement measurement device 16 integral with the figurine. Additionally, the measurement device has one side of the measurement wheel with indicia alternating between "rock", "paper", and "scissors". When two male figurines approach the same element (e.g. a part of a wheel axle) in the same turn the players engage in a combat whose outcome is based upon the display of the two paper—rock—scissors on each figurines device 16 (for sake of completeness: paper defeats rock, rock defeats scissors and scissors defeats paper). The winner is awarded the element and the loser is frozen until touched by a female figurine of the clan.

Further specifics of the game are not relevant here. The game is not limited to a pre-printed board layout but allows easy calculation of the piece movement during game play. Further the rules combine the well known concepts of freeze tag and paper—rock—scissors in the game play. This is only one representation of the many games possible with the equipment of the present invention. The template used in building the illustrated structures can also be modified so that the players can build any desired structure (e.g. templates can be designed to replicate the Eiffel tower, The White House, etc). The templates can be utilized with essentially any block building set such as those sold under the trademark LEGO®. The easily connected and disconnected sub-bases 150 are universal as described. Consequently the present invention is believed to open up the area of game design and improve game play in specific areas.

The invention has therefore been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A gaming system comprising a plurality of bases, each base configured for receiving and supporting a miniature figurine thereon, wherein each base includes at least one attachment member for interconnecting the base with an adjacent base, wherein each base includes a record tracking system for recording and displaying variable characteristics of an associated figurine.

2. The gaming system of claim 1 further including a movement measurement device constructed to measure range values of the miniature figurines and including an attaching member for connecting to the miniature figurines.

3. The gaming system as claimed in claim 2 wherein said movement measurement device is a housing with a measuring wheel having body indicia positioned thereon.

4. The gaming system of claim 1 wherein each attachment member is on a peripheral edge of the base.

5. The gaming system of claim 4 wherein a plurality of attachment members are provided on each base, and wherein each base can be interconnected with a plurality of adjacent bases.

6. The gaming system of claim 1 further including a plurality of vertically stackable pedestals which are selectively interposed between the base and the associated miniature figurine to adjust the height of the figurine above the base.

7. The gaming system of claim 1 further including a plurality of post receiving holes in the base for receiving mounting posts on the miniature figurine.

8. The gaming system of claim 1 further including a raised edge on the periphery of each base, wherein the raised edge is dimensioned to fit selected miniature figurines that may be received on the base.

9. The gaming system of 1 wherein each record tracking system includes a plurality of independent record display members.

10. The gaming system of claim 9, wherein each record display member includes a slide track, a plurality of indicia on the base along the slide track and a slide member slide-able along the track.

11. The gaming system of claim 9 wherein the display of the record tracking system is selectively obstructed in plan view during game play.

12. A gaming system comprising a plurality of bases, each base supporting a miniature toy figurine thereon and including a record tracking system on each base, each record tracking system including a plurality of independent record display members, wherein each record display member includes a slide track, a plurality of indicia on the base along the slide track and a slide member slide-able along the slide track.

13. The gaming system of claim 12 wherein each base includes at least three independent record display members, wherein each base includes at least one attachment member for interconnecting the base with an adjacent base, and wherein the miniature figurine is removable from the base.

14. The gaming system of claim 13 wherein the display of the record tracking system is selectively obstructed in plan view.

15. A miniature toy figurine base having a miniature toy figurine releasable from and supported thereon, the base including a record tracking system on the base for recording and displaying variable characteristics of the miniature toy figurine, wherein the display of the record tracking system is selectively obstructed in plan view by at least the miniature toy figurine.

16. The miniature base of claim 15, wherein the record tracking system includes a plurality of independent record display members with each record display member including a slide track, a plurality of indicia on the base along the slide track and a slide member slide-able along the track.

17. The miniature base of claim 16, further including at least one attachment member for interconnecting the base with an adjacent base.

18. The miniature base of claim 17 further including an attachable movement measurement device constructed to measure range values of the miniature toy figurines.

19. A miniature figurine base supporting a miniature figurine thereon and including a record tracking system, the record tracking system including a plurality of independent record display members that include a slide track, a plurality of indicia on the base along the slide track and a slide member slide-able along the track.

* * * * *